US005449431A

United States Patent [19]

Isowa

[11] Patent Number: 5,449,431

[45] Date of Patent: Sep. 12, 1995

[54] SINGLE FACER IN CORRUGATOR HAVING A PLURALITY OF FLUTING UNITS

[75] Inventor: Eiichi Isowa, Nagoya, Japan

[73] Assignee: Kabushiki Kaisha Isowa, Aichi, Japan

[21] Appl. No.: 330,442

[22] Filed: Oct. 28, 1994

[30] Foreign Application Priority Data

Nov. 8, 1993 [JP] Japan ..... 5-303392

[51] Int. Cl.[6] ..... B31F 1/28

[52] U.S. Cl. ..... 156/472; 156/471; 156/473; 156/205; 156/210

[58] Field of Search ..... 156/472, 473, 471, 470, 156/205, 210, 555; 425/336, 368, 369, 370; 493/463

[56] References Cited

U.S. PATENT DOCUMENTS

| | | | |
|---|---|---|---|
| 2,793,674 | 5/1957 | Reinhard | 156/471 |
| 4,620,896 | 11/1986 | Sueki et al. | 156/471 |
| 4,631,109 | 12/1986 | Hirakawa et al. | 156/210 |
| 4,738,744 | 4/1988 | Saller | 156/473 |
| 4,773,963 | 9/1988 | Seki et al. | 156/471 |
| 4,814,038 | 3/1989 | Hayashi et al. | 156/472 |
| 4,818,330 | 4/1989 | Mosburger | 156/472 |
| 5,122,221 | 6/1992 | Isowa et al. | 156/471 |

FOREIGN PATENT DOCUMENTS

| | | | |
|---|---|---|---|
| 329966 | 12/1993 | Japan | 156/471 |
| 338067 | 12/1993 | Japan | 156/472 |

*Primary Examiner*—Michele K. Yoder
*Attorney, Agent, or Firm*—Koda and Androlia

[57] ABSTRACT

Disclosed is a single facer provided with a plurality of fluting units, each consisting of an upper fluted roll and a lower fluted roll which engages with the upper fluted roll and forms a predetermined corrugation on a corrugating medium to be passed between the upper fluted roll and the lower fluted roll in the corresponding fluting unit and to paste a liner onto the glued crests of the corrugating medium; the single facer comprising a single fixed supporting member disposed adjacent to and to oppose to all of the lower fluted rolls via a route of feeding the liner fed to the corresponding fluting unit; a sleeve-like endless belt wound around the supporting member to be able to run freely therearound; and a plurality of pressing members disposed to oppose, via the endless belt, to the lower fluted rolls to be parallel with the respective lower fluted rolls; the pressing members being able to be moved, while maintaining the horizontal posture, closer to the corresponding lower fluted rolls with the aid of predetermined urging means; wherein the pressing member is moved closer to the lower fluted roll under urging by the corresponding urging means to bring that portion of the endless belt opposing to the pressing member closer to the corresponding lower fluted roll, so that the liner may be brought into press contact with the glued crests of the corrugating medium by the endless belt.

2 Claims, 9 Drawing Sheets

SINGLE FACER IN CORRUGATOR HAVING A PLURALITY OF FLUTING UNITS

BACKGROUND OF THE INVENTION

1. Field of the Invention

This invention relates to an apparatus for selectively forming different flute types of single-faced corrugated board sheets in one single facet.

2. Description of the Related Art

There has been known a single facer which forms a single-faced corrugated board sheets by allowing a corrugating medium to have a corrugation with a predetermined pitch size, and pasting the medium with a liner at the crests of corrugation using a glue. The single facer comprises an upper fluted roll and a lower fluted roll both having a wavy flutes on the circumference, which are rotatably supported on a frame in such a way that their fluted circumferences may be engaged in a vertical relationship, and a press roll which is designed to be brought into press contact with the lower fluted roll through the corrugating medium and liner. The corrugating medium is allowed to have a predetermined corrugation or flutes as it is fed between the upper fluted roll and the lower fluted roll under engagement of their fluted circumferences, and also a glue is applied to the crests of corrugation by a gluing roll provided in a gluing mechanism. The liner being fed from the opposite side of the corrugating medium through the press roll is bonded to the crests of the corrugating medium as nipped between the press roll and the lower fluted roll so as to form a single-faced corrugated board.

Single-faced corrugated boards are generally classified into Flute A, Flute B, Flute C, Flute D, Flute E, Flute No. 4, Flute No. 5, etc. depending on the depth of the flutes to be formed on the corrugating medium and the standard number of crests per 30 cm. The flute type can be selected depending on the flute profile of the upper and lower fluted rolls to be disposed in the single facer.

As described above, there are many flute types in the single-faced corrugated boards and the flute type is dependent upon the flute profiles of the upper and lower fluted rolls incorporated in the single facer. Accordingly, in order to form different types of single-faced corrugated boards in one single facet, there has been employed a constitution, in which a plurality of single facers are arranged in the corrugator line to make selective operation of the desired single facer.

In such system, however, the installation cost is of course doubled because of the plurality of single facers disposed, and besides there are many other problems involved with respect to the installation area, operability, incidental equipment, etc. for the system to be put into practical uses. Moreover, the combination of different flute types of single-faced corrugated boards to be formed selectively cannot be selected at random, but restricted to predetermined combinations, for example, flute A and flute E, flute B and flute E, and flute C and flute E. Under such circumstances, there are proposed various types of single facers, in which two sets of fluting units having different types of flute profiles are disposed in one single facer, whereby to form different flute types of single-faced corrugated boards by selectively using these fluting units.

For example, there is "A single facer" disclosed in Japanese Unexamined Patent Publication (Kokai) No. Sho 61-58881 which was previously filed by the present applicant. In the single facer according to the previous invention, as shown in the drawings attached to the Publication thereof, a first fluting unit consisting of a pair of fluted rolls and a second fluting unit also consisting of a pair of fluted rolls are disposed, respectively, diagonally above and diagonally below a press roll which can selectively be combined with these two units, and thus different types of single-faced corrugated boards can be formed by selecting the first fluting unit or the second fluting unit to be combined with the press roll.

In the single facer described above, different types of single-faced corrugated boards can be formed merely by shifting the press roll, and this system can adequately be evaluated highly. However, since the press roll itself is very heavy, a large-scaled supporting mechanism and a large-scaled adjusting mechanism are required so as to achieve shifting of the press roll and adjustment thereof with high positioning accuracy when it is stopped. Further, since the press roll is designed to be rotationally driven in synchronization with the running speed of the corrugating medium and liner, a complicated constitution of mechanism for connecting the press roll with a drive source, which permits shifting of the position of the press roll under the adjustment, becomes necessary, leading to cost elevation.

The press roll is of a large-diameter metallic roll which is normally urged toward the lower fluted roll of the first or second fluting unit so as to apply a predetermined nip pressure to the corrugating medium and the liner passing between these two rolls. Since flutes consisting of continuous alternative repetition of crests and troughs are formed at a predetermined pitch on the circumference of the lower fluted roll, the rotation center of the lower fluted roll and that of the press roll shift slightly as the point of press contact therebetween shifts from the trough to the crest or vice versa. Thus, as the result that the rotation centers of these rolls make cyclic reciprocating motions to be closer to or farther from each other as they rotate, great vibration and big noise are generated during formation of the single-faced corrugated board, causing the working environment in the plant to be worsened considerably. Besides, since both the press roll and the lower fluted roll are made of rigid metallic materials, an impact is periodically applied to the press roll (so-called the hammer phenomenon) every time the crests of the lower fluted roll are abutted against the press roll. Accordingly, linear press marks corresponding to the pitch of the crests of the lower fluted roll are formed horizontally on the surface of the liner in the thus formed single-faced corrugated board, disadvantageously.

In the single facer where a press roll and a lower fluted roll are employed as described above, these two rolls are brought into linear contact with each other via the corrugating medium and liner, so that the corrugating medium and the liner are nipped therebetween merely over a very narrow zone. Accordingly, if the speed of forming a single-faced corrugated board is set at a high level to shorten the time that the corrugating medium and liner pass between these two rolls, it is liable that the corrugating medium fails to be securely pasted with the liner. Thus, high-speed running of the single facer has been difficult. In addition, due to the same reason, pasting of a thick corrugating medium with a thick liner cannot successfully be achieved, disadvantageously.

This invention has been proposed in view of the disadvantages inherent in the prior art single facers provided with a plurality of fluting units which can form single-faced corrugated boards of different flute types and in order to overcome them in a successful manner, and is directed to provide an inexpensive single facer having a simple structure, which can cope with high-speed formation of single-faced corrugated boards and also can minimize vibration or noise during the operation.

SUMMARY OF THE INVENTION

In order to solve the problems described above and to attain the intended objects suitably, this invention provides a single facer provided with a plurality of fluting units each consisting of a roll pair consisting of an upper fluted roll having wavy flutes formed on the circumference and a lower fluted roll having wavy flutes formed on the circumference which engage with those of the upper fluted roll and forms a predetermined corrugation on a corrugating medium to be passed between the upper fluted roll and the lower fluted roll in the corresponding fluting unit and to paste a liner onto the glued crests of the corrugating medium so as to form a single-faced corrugated board; the single facer comprising a single fixed supporting member disposed adjacent to and to oppose to all of the lower fluted rolls via a route of feeding the liner fed to the corresponding fluting unit; a sleeve-like endless belt wound around the supporting member (to be able to rotate freely therearound; and a plurality of pressing members disposed to oppose, via the endless belt wound around the supporting member, to the lower fluted rolls of the fluting units to be parallel with the lower fluted rolls, respectively; the pressing members being able to be moved, while maintaining the horizontal posture, closer to the corresponding lower fluted rolls under urging by predetermined urging means; wherein the pressing member is moved closer to the lower fluted roll of the corresponding fluting unit under the action of the urging means to bring that portion of the endless belt opposing to the pressing member closer to the lower fluted roll, so that the liner may be brought into press contact by the endless belt with the glued crests of the corrugating medium fed along the circumference of the lower fluted roll.

BRIEF DESCRIPTION OF THE DRAWINGS

The features of this invention that are believed to be novel are set forth with particularity in the appended claims. The invention, together with the objects and advantages thereof, may best be understood by reference to the following description of the preferred embodiments taken in conjunction with the accompanying drawings in which:

DETAILED DESCRIPTION OF THE PREFERRED EMBODIMENTS

Next, the single facer of the invention will be described by way of preferred embodiments referring to the attached drawings. It should be noted here that the distinction between the upper fluted roll and the lower fluted roll is not made based on the spatial relationship but made relative to the endless belt and that those fluted rolls which are brought into press contact with the endless belt via the liner and corrugating medium are appreciated to be "the lower fluted rolls".

Figure 1:
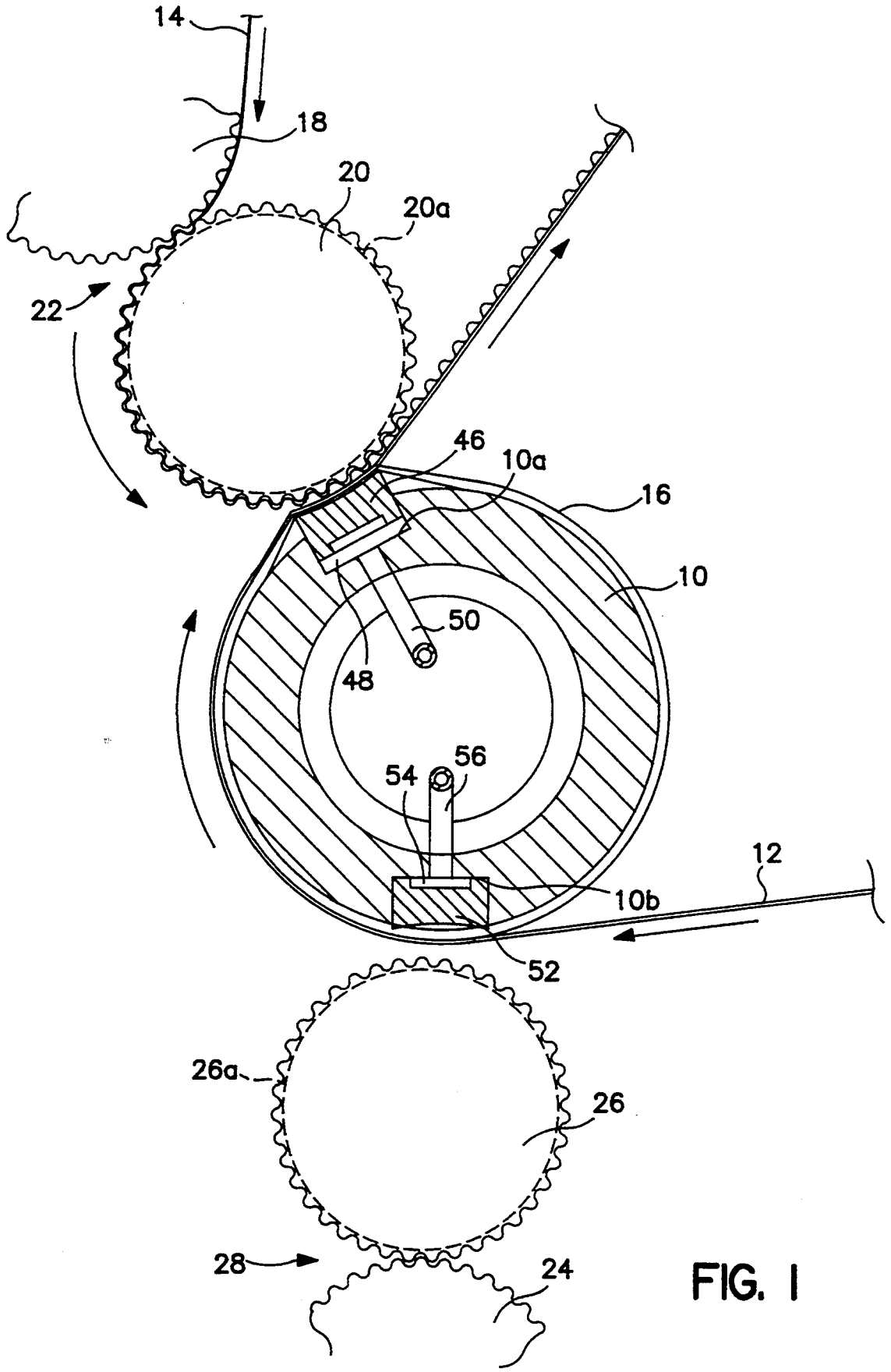
FIG. 1 shows, in partial cross section, a front view of the major section of a single facet according to a preferred embodiment of the invention.
Figure 5:
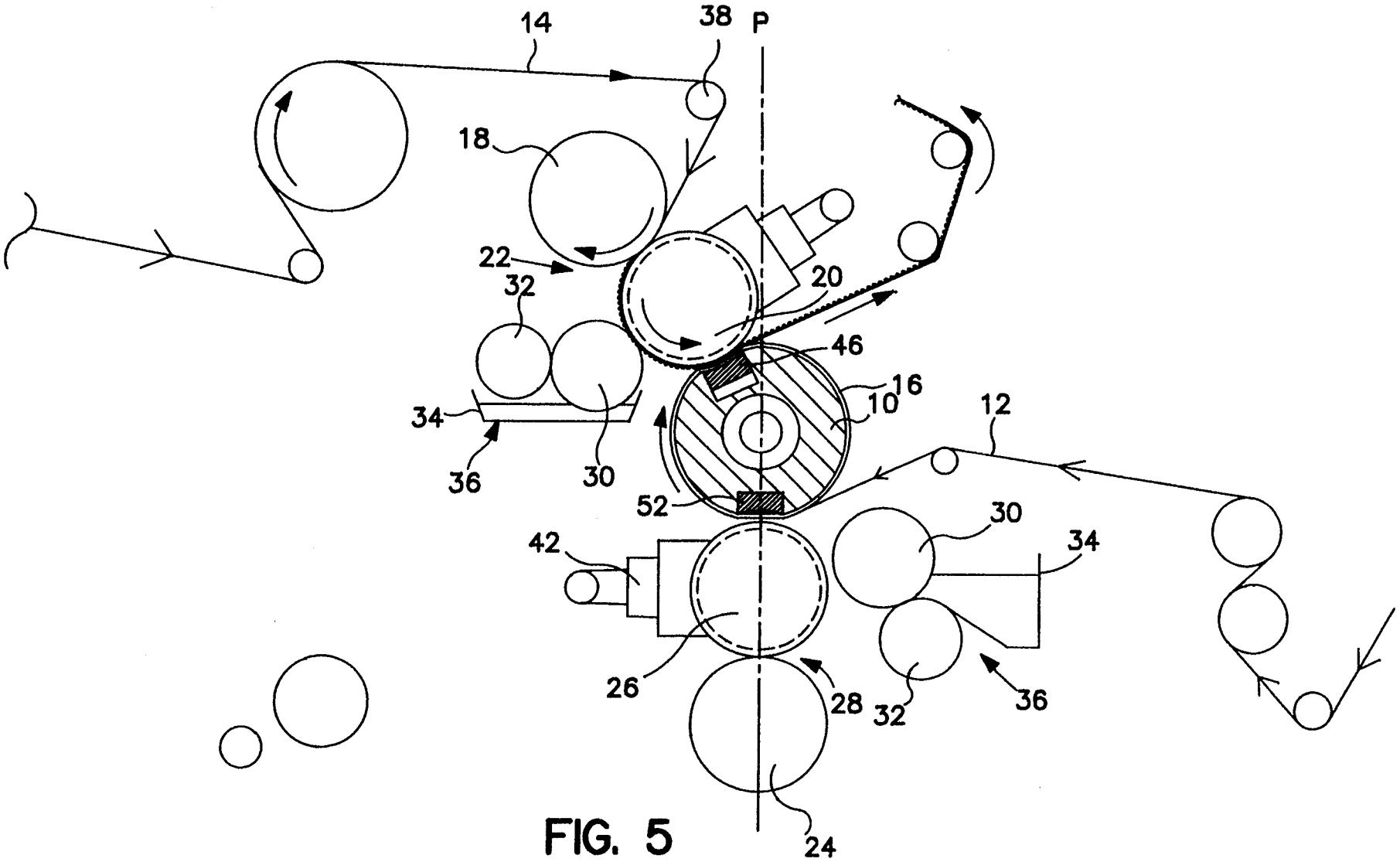
FIG. 5 shows schematically a constitution of the single facer according to the preferred embodiment of the invention, where a single-faced corrugated board is being formed in the first fluting unit.

FIG. 1 shows schematically the constitution of the single facer according to a preferred embodiment of the invention, in which the reference number 10 denotes a supporting roll (to be described later) on which an endless belt 16 is rotatably wound. The endless belt 16 is directed to guide a liner 12 and to allow it to be pasted with the glued crests of a corrugating medium 14 with pressure. A first fluting unit 22 consisting of a pair of rolls, i.e. an upper fluted roll 18 and a lower fluted roll 20, is disposed diagonally above this supporting roll 10, whereas a second fluting unit 28 consisting of a pair of rolls, i.e. an upper fluted roll 24 and a lower fluted roll 26, is disposed below the supporting roll 10. Namely, as shown in FIG. 5, the first fluting unit 22 locating above the supporting roll 10 is arranged diagonally on the left side of the perpendicular line P intersecting the axis of the supporting roll 10, while the second fluting unit 28 locating below the supporting roll 10 is disposed vertically in alignment with the perpendicular line P. Meanwhile, the upper and lower fluted rolls 18,20/24,26 have wavy flutes formed on the circumferences, respectively, and a predetermined corrugation can be formed on the corrugating medium 14 under engagement of the flutes of these rolls. It should be noted that the flute profile formed on the fluted rolls 18,20 in the first fluting unit 22 is different from that formed on the fluted rolls 24,26 in the second fluting unit 28.

Figure 3:
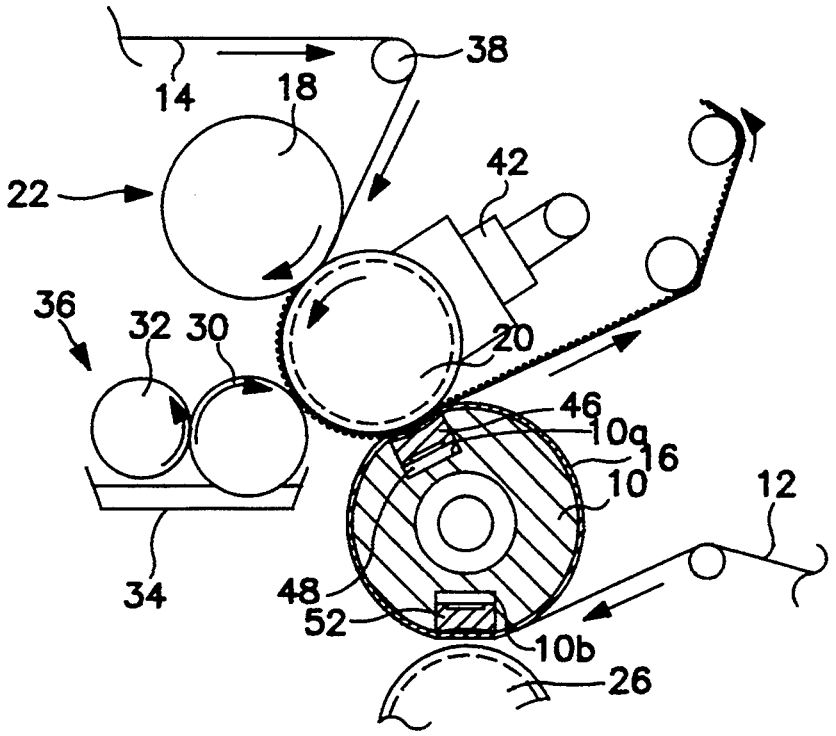
FIG. 3 shows schematically a front view of the first fluting unit in the single facer according to the preferred embodiment of the invention.

Gluing mechanisms 36 each consisting of a gluing roll 30, a doctor roll 32 and a glue pan 34 are disposed in the first fluting unit 22 and the second fluting unit 28, respectively. The gluing mechanism 36 disposed in the first fluting unit 22 locates on the left side (FIG. 5) of the lower fluted roll 20. The corrugating medium 14 is fed from a web feeding source (not shown) assumed to locate on the left side of FIGS. 3 and 5 through a guide roll 38 disposed above the first fluting unit 22 to the engagement zone defined between the upper fluted roll 18 and the lower fluted roll 20, and thus a predetermined corrugation can be formed on the corrugating medium 14 by passing through this zone. The thus corrugated corrugating medium 14 is glued at the crests of corrugation by the gluing mechanism 36 and then diverted upward along the circumference of the lower fluted roll 20.

Meanwhile, the gluing mechanism 36 disposed in the second fluting unit 28 is disposed on the right side of the lower fluted roll 26. The corrugating medium 14 is fed from the web feeding source (not shown) assumed to locate on the left side of FIG. 6 through a guide roll 40 to the engagement zone defined between the upper fluted roll 24 and the lower fluted roll 26, and thus a predetermined corrugation can be formed on the corrugating medium 14 by passing through this zone. The thus corrugated corrugating medium 14 is glued at the crests of corrugation by the gluing mechanism 36 and then diverted upward along the circumference of the lower fluted roll 26.

The lower fluted rolls 20,26 in the respective fluting units 22,28 each have a plurality of circumferential grooves **20*a*,26*a* (see FIG. 2) formed on the circumference thereof, and suction means 42 are disposed on one side of each lower fluted roll 20(26) opposite to the position where the corrugating medium 14 is allowed to pass. Each of the suction means 42 is actuated to generate a negative pressure in the circumferential grooves 20*a*,26*a* of the lower fluted roll 20(26), and thus the corrugating medium 14 having a predetermined corrugation is adapted to be fed stably as sucked onto the circumference of the lower fluted roll 20(26)**.

Figure 6:
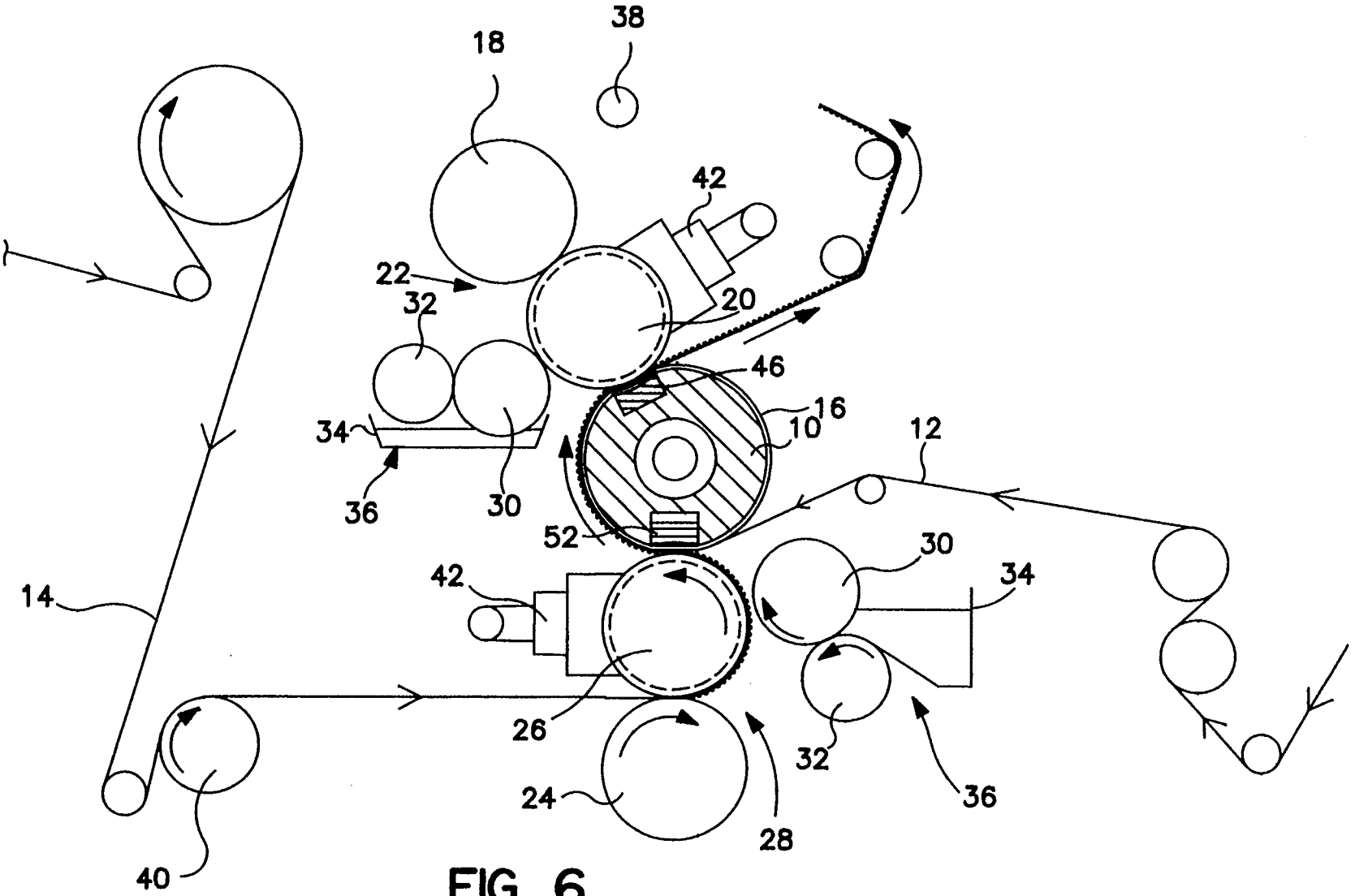
FIG. 6 shows schematically a constitution of the single facer according to the preferred embodiment of the invention, where a single-faced corrugated board is being formed in the second fluting unit.

In this basic arrangement, the endless belt 16 wound around the supporting roll 10 is designed to be selectively moved closer to the first fluting unit 22 or the second fluting unit 28. Thus, a single-faced corrugated board is designed to be formed using the combination of the endless belt 16 and the lower fluted roll 20 of the first fluting unit 22 (FIG. 5) or the combination of the endless belt 16 and the lower fluted roll 26 of the second fluting unit 28 (FIG. 6).

Figure 2:
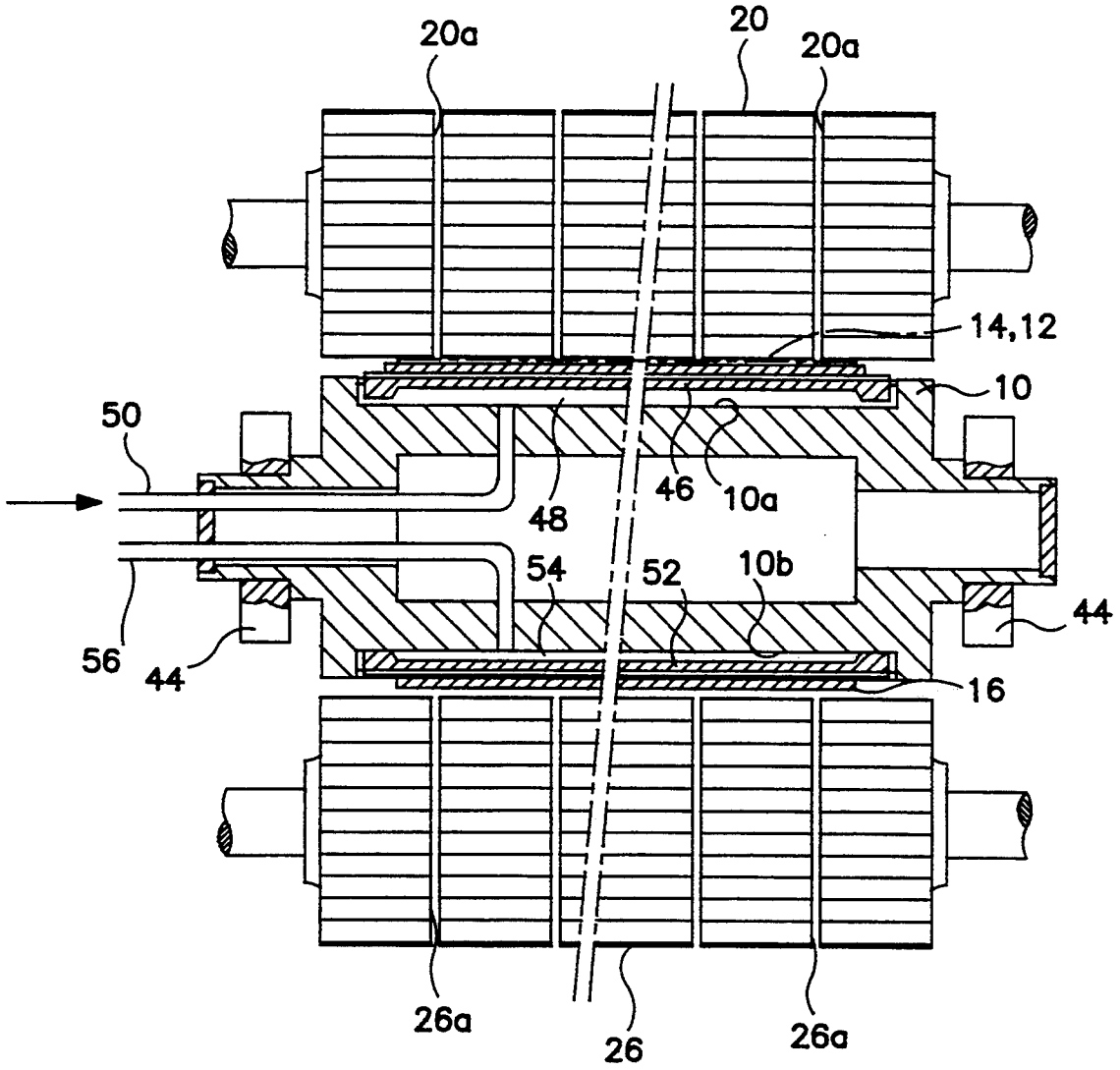
FIG. 2 shows, in partial cross section, a side view of the major section of the single facer according to the preferred embodiment of the invention.

As shown in FIG. 2, the supporting roll 10 is disposed between the lower fluted roll 20 of the first fluting unit 22 and the lower fluted roll 26 of the second fluting unit 28 in parallel with these rolls 20,26. The supporting roll 10 is secured on a pair of brackets 44 (only parts of them are shown) standing, as spaced from each other in the axial direction of the lower fluted roll 20(26), from the floor of a plant, with the circumference of the roll 10 locating close to the lower fluted rolls 20,26 with predetermined clearances, respectively. Further, the endless belt 16 wound slidably around the supporting roll 10 has a sleeve-like form and also has an inner diameter slightly greater than the outer diameter of the roll 10. The width of the endless belt 16 is designed to be greater than those of the corrugating medium 14 and liner 12, so that the corrugating medium 14 fed along the circumference of the lower fluted roll 20(26) and the liner 12 to be pasted therewith may be nipped over the full width thereof between the endless belt 16 and the corresponding lower fluted roll 20(26) by moving a first pressing member 46 (to be described later) or a second pressing member 52 (to be described later) toward the corresponding lower fluted roll 20(26). Incidentally, a seamless resin belt can suitably be used as the endless belt 16.

A first elongated groove 10a is formed on the supporting roll 10 to be parallel with the lower fluted roll 20 in the first fluting unit 22 at the position opposing via the endless belt 16 to the rotation center of the lower fluted roll 20, and a first pressing member 46 is fitted in the groove **10*a* to be slidable in the radial direction of the supporting roll 10, as shown in FIG. 2. A first pressure space 48 is defined between the bottom of the first pressing member 46 and the bottom of the first elongated groove 10*a*, and the space 48 communicates to a first supply pipe 50 led out of an air supply source (not shown) and arranged through the supporting roll 10. Namely, by feeding a compressed air to the first pressure space 48 through the first supply pipe 50, the first pressing member 46 can be moved radially outward, while maintaining the horizontal posture, along the first elongated groove 10*a* under the action of the compressed air, and the outer surface of the first pressing member 46 projects above the circumference of the supporting roll 10. Thus, that portion of the endless belt 16 wound around the supporting roll 10 which opposes to the first pressing member 46 is brought closer to the lower fluted roll 20**.

Meanwhile, a second elongated groove **10*b* is formed on the supporting roll 10 to be parallel with the lower fluted roll 26 in the second fluting unit 28 at the position opposing via the endless belt 16 to the rotation center of the lower fluted roll 26, and a second pressing member 52 is fitted in the groove 10*b* to be slidable in the radial direction. A second pressure space 54 is defined between the bottom of the second pressing member 52 and the bottom of the second elongated groove 10*b*, and the space 54 communicates to a second supply pipe 56 led out of an air supply source (not shown) and arranged through the supporting roll 10. Namely, by feeding a compressed air to the second pressure space 54 through the second supply pipe 56, the second pressing member 52 can be moved radially outward, while maintaining the horizontal posture, along the second elongated groove 10*b* under the action of the compressed air, and the outer surface of the second pressing member 10*b* projects above the circumference of the supporting roll 10. Thus, that portion of the endless belt 16 wound around the supporting roll 10 which opposes to the second pressing member 52 is brought closer to the lower fluted roll 26**.

As described above, if a compressed air is supplied to the first pressure space 48 through the first supply pipe 50, that portion of the endless belt which is opposing to the first pressing member 46 can be abutted against the lower fluted roll 20 of the first fluting unit 22 (see FIG. 5). Meanwhile, if a compressed air is supplied to the second pressure space 54 through the second supply pipe 56, that portion of the endless belt 16 which is opposing to the second pressing member 52 can be abutted against the lower fluted roll 26 of the second fluting unit 28 (see FIG. 6).

Figure 4:
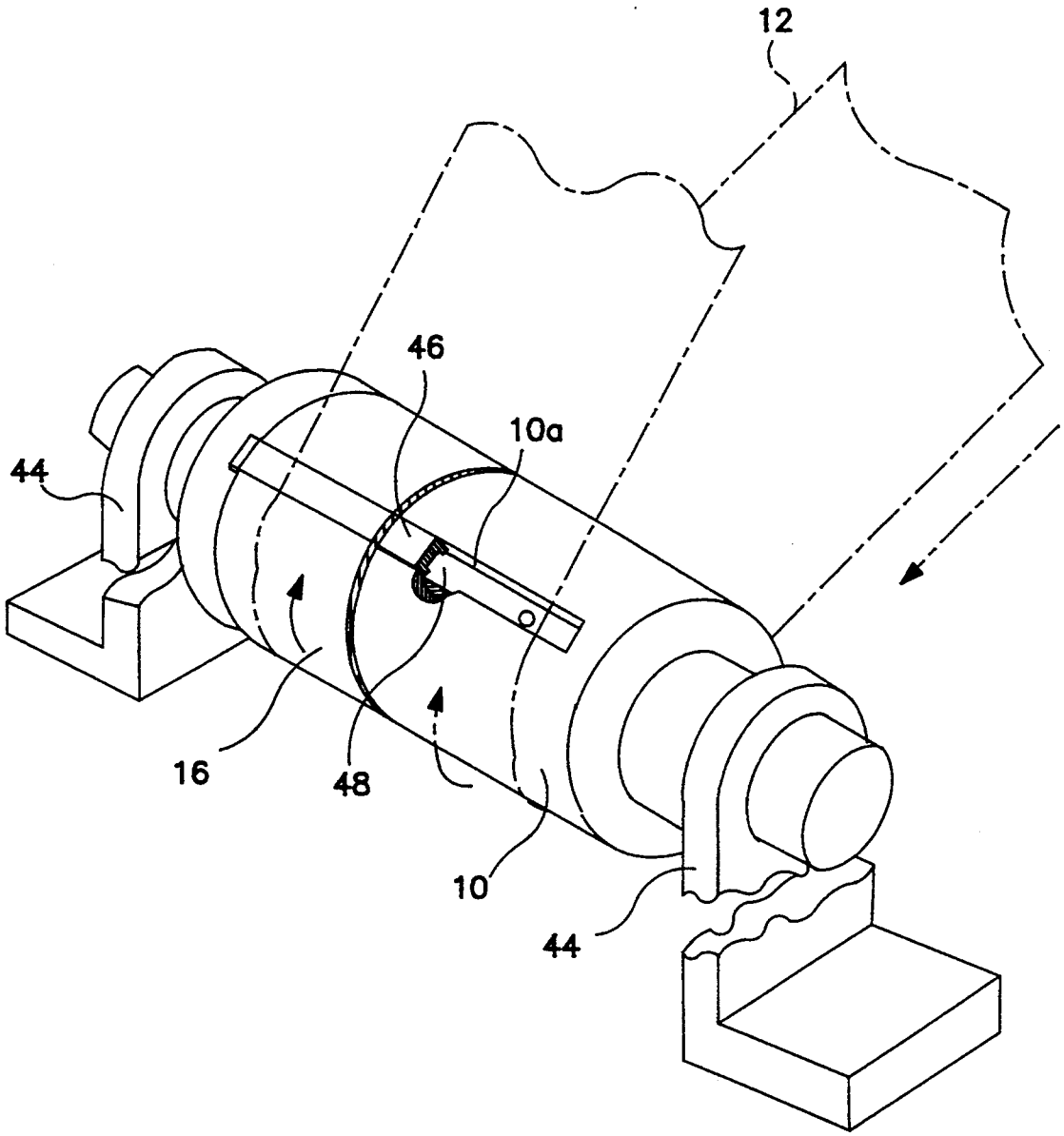
FIG. 4 shows schematically a partially cut-away perspective view of a supporting roll according to the preferred embodiment of the invention.

As shown in FIGS. 2 and 4, the first pressing member 46 and the second pressing member 52 are designed to be longer than the width of the endless belt 16, so that a uniform nip pressure may be applied over the entire width of the corrugating medium 14 and the liner 12 when the endless belt 16 is moved closer to the lower fluted roll 20(26) by the corresponding pressing member 46(52). Incidentally, sealing members are interposed between the outer surfaces of the first pressing member 46 and the second pressing member 52 and the inner surfaces of the corresponding elongated grooves 10*a*,10*b*, respectively, so that the compressed air in the pressure space 48(54) may not escape therefrom.

The outer surface of the first pressing member 46 and that of the second pressing member 52 are arcuated after the circumferences of the lower fluted rolls 20,26, respectively, so that the corrugating medium 14 and the liner 12 may be nipped between the pressing member 46(52) and the corresponding lower fluted roll 20(26) over a predetermined length. Thus, if the speed of forming a single-faced corrugated board is set at a high level, the corrugating medium 14 is adapted to be securely pasted with the liner 12. Incidentally, since the endless belt 16 is adapted to slide along the circumference of the supporting roll 10 as the liner 12 runs when the belt 16 is pressed against the liner 12 by the pressing member 46(52), it is recommended to supply a lubricant between the endless belt 16 and the supporting roll 10 so as to minimize the frictional resistance therebetween. Otherwise, the inner surface of the endless belt 16 and the circumference of the supporting roll 10 may be coated with a material having a very low frictional resistance etc. It should be noted, however, that the endless belt 16 is designed to be moved as abutted against the liner 12 following the running thereof, so that the outer surface of the endless belt 16 to be abutted against the liner 12 is desirably made of or treated with a material which does not cause slipping with the liner 12.

It is also recommended to form regulating members on the circumference of the supporting roll 10 so as to regulate the axial shifting of the endless belt 16 or to form a groove which is substantially as wide as the endless belt 16 on the circumference of the supporting roll 10 so as to allow the endless belt 16 to slide in this groove. Further, a hot steam may be circulated through the inner space of the supporting roll 10 and warm the bonding areas of the corrugating medium 14 with the liner 12 via the endless belt 16 so as to accelerate bonding therebetween.

Next, the operation of the single facer according to the above embodiment will be described. When a single-faced corrugated board is to be formed in the above-described single facer using the combination of the first fluting unit 22 and the endless belt 16, a compressed air is supplied to the first pressure space 48 through the first supply pipe 50. Thus, the first pressing member 46 is moved radially outward along the first elongated groove 10*a*, and the endless belt 16 wound around the supporting roll 10 is pushed closer to the lower fluted roll 20 in the first fluting unit 22. Accordingly, as shown in FIGS. 1 and 5, the liner 12 is pressed via the endless belt 16 against the corrugating medium 14 fed along the circumference of the lower fluted roll 20. The endless belt 16 pressed against the liner 12 slides along the circumference of the supporting roll 10 as the liner 12 and the corrugating medium 14 run. Namely, the corrugating medium 14 having passed between the upper fluted roll 18 and the lower fluted roll 20 in the first fluting unit 22 to be provided with a corrugation of a desired flute type and also glued at the crests of corrugation by the gluing mechanism 36 is pasted with the liner 12 fed together with the endless belt 16 as nipped between the endless belt 16 and the lower fluted roll 20, and thus a single-faced corrugated board can be formed.

When the operation mode of forming one flute type of single-faced corrugated board using the above-described combination is switched to another operation mode of forming a different flute type of single-faced corrugated board, the endless belt 16 is pushed closer via the second pressing member 52 to the lower fluted roll 26 in the second fluting unit 28.

More specifically, the first pressing member 46 is returned to the stand-by position in the first elongated groove 10a by releasing the urging force applied to the first pressing member 46, whereby to allow the endless belt 16 to be spaced from the lower fluted roll 20 in the first fluting unit 22. Subsequently, a compressed air is supplied via the second supply pipe 56 to the second pressure space 54. Thus, the second pressing member 52 is moved radially outward along the second elongated groove 10*b* to push the endless belt 16 wound around the supporting roll 10 closer to the lower fluted roll 26 in the second fluting unit 28. Accordingly, as shown in FIG. 6, the liner 12 is pressed via the endless belt 16 against the corrugating medium 14 fed along the circumference of the lower fluted roll 26. The endless belt 16 pressed against the liner 12 slides along the circumference of the supporting roll 10 following the running of the liner 12 and corrugating medium 14. Namely, the corrugating medium 14 having passed between the upper fluted roll 24 and the lower fluted roll 26 in the second fluting unit 28 to be provided with a corrugation of a desired flute type and also glued at the crests of corrugation by the gluing mechanism 36 is pasted with the liner 12 fed together with the endless belt 16 as nipped between the endless belt 16 and the lower fluted roll 26, and thus a single-faced corrugated board which is of a different flute type from that of the one to be formed by the first fluting unit 22 can be formed.

In either case where the first fluting unit 22 or the second fluting unit 28 is selected, the corrugating medium 14 and the liner 12 are nipped over a predetermined length between the corresponding portion of the endless belt 16 facing the first pressing member 46 or the second pressing member and the corresponding lower fluted roll 20(26), whereby secured bonding at the glued portions can be achieved. Incidentally, the nip pressure to be applied to the corrugating medium 14 and the liner 12 can easily be secured with high accuracy by adjusting the amount of the compressed air to be fed to the corresponding pressure space 48(54).

As described above, different types of single-faced corrugated boards can be formed merely by bringing the endless belt 16 wound around the single supporting roll 10 selectively closer to the first fluting unit 22 or the second fluting unit 28 with the aid of the first pressing member 46 or the second pressing member 52. Namely, since the heavy supporting roll 10 need not be shifted, the supporting mechanism can be simplified, and besides the large-scaled adjusting mechanism can be omitted, leading to cost reduction. Further, since the endless belt 16 is designed to slide as the liner 12 runs, no positive means for driving the endless belt 16 is necessary, and thus the mechanism can be simplified. Besides, since the corrugating medium 14 is pressed against the liner 12 by the endless belt 16, the possible vibration or noise to be generated during the formation of the single-faced corrugated board can greatly be reduced, and also the press marks which are liable to be formed on the liner 12 of the single-faced corrugated board can be minimized. Moreover, since the supporting roll 10 is fixed, the supply pipes 50,56 for feeding a compressed air, the means for feeding a lubricant (not shown) and the means for supplying a hot steam (not shown) can easily be arranged, advantageously.

Figure 7:
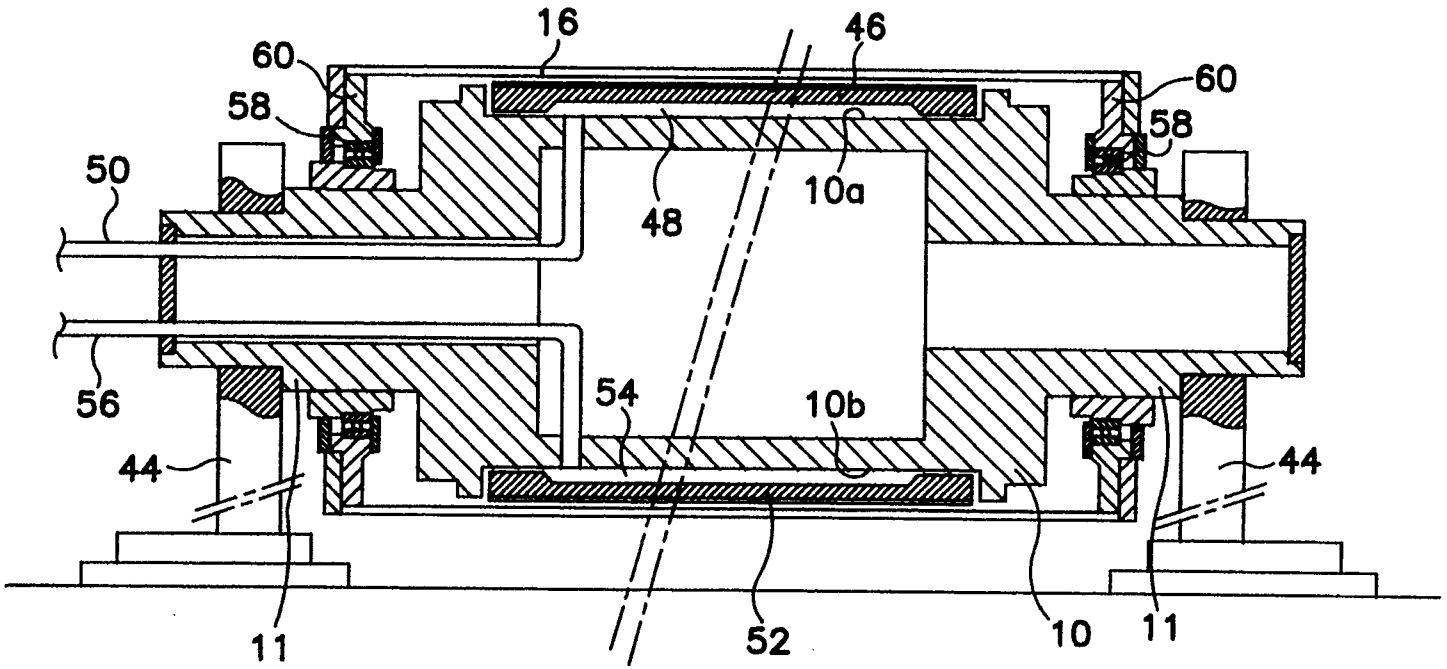
FIG. 7 shows, in vertical cross-section, a variation of the arrangement of the endless belt with respect to the supporting roll according to the preferred embodiment of the invention.

FIG. 7 shows a variation of the arrangement of the endless belt 16 with respect to the supporting roll 10. Discs 60 are fitted rotatably on the small-diameter shaft portions formed at each end portion of the supporting roll 10 via bearings 58, respectively. The diameter of each disc 60 is designed to be greater than that of the supporting roll 10, and the endless belt 16 extended between these discs 60 to be fixed on the circumferences thereof is designed to be extended outer than the supporting roll 10. In this variation, when the endless belt 16 is pressed against the liner 12 with the aid of the first pressing member 46 or the second pressing member 52, the endless belt 16 and the discs 60 rotate relative to the supporting roll 10 as the liner 12 runs.

Figure 8:
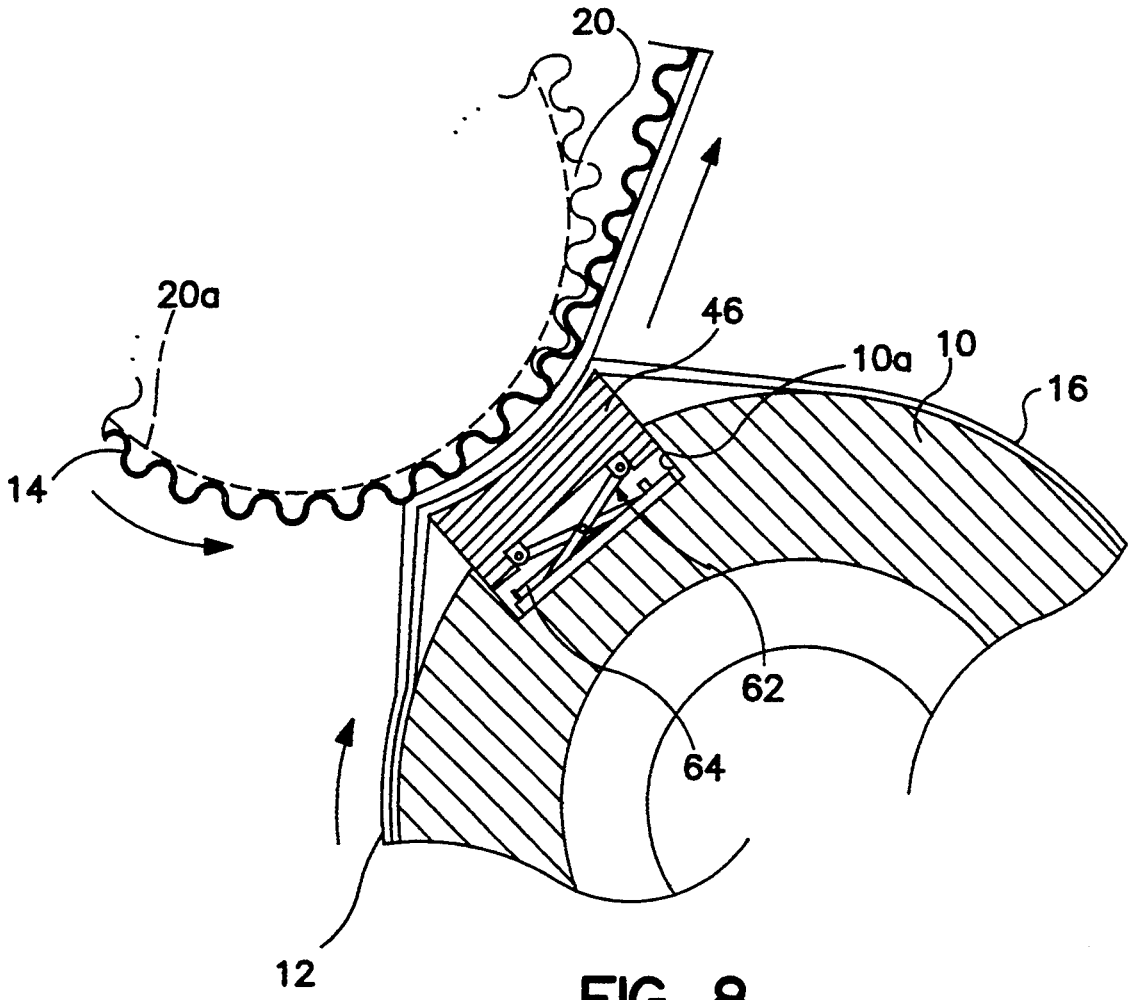
FIG. 8 shows an explanatory view of the major section of a variation of the means for urging a pressing member according to the preferred embodiment of the invention.

FIG. 8 shows a variation of the means for urging the first pressing member 46 or the second pressing member 52, in which the means for urging the first pressing member 46 (to be described later) is illustrated, which will be described below. A pantographic lifter 62 is disposed in the first elongated groove 10*a* of the supporting roll 10, and the first pressing member 46 is designed to be reciprocated in the radial direction along the first elongated groove 10*a* by positively or negatively operating the lifter 62 by a cylinder 64. The use of such lifter 62 enables shifting of the first pressing member 46 closer to or farther from the lower fluted roll 20, while maintaining the horizontal posture.

Figure 9:
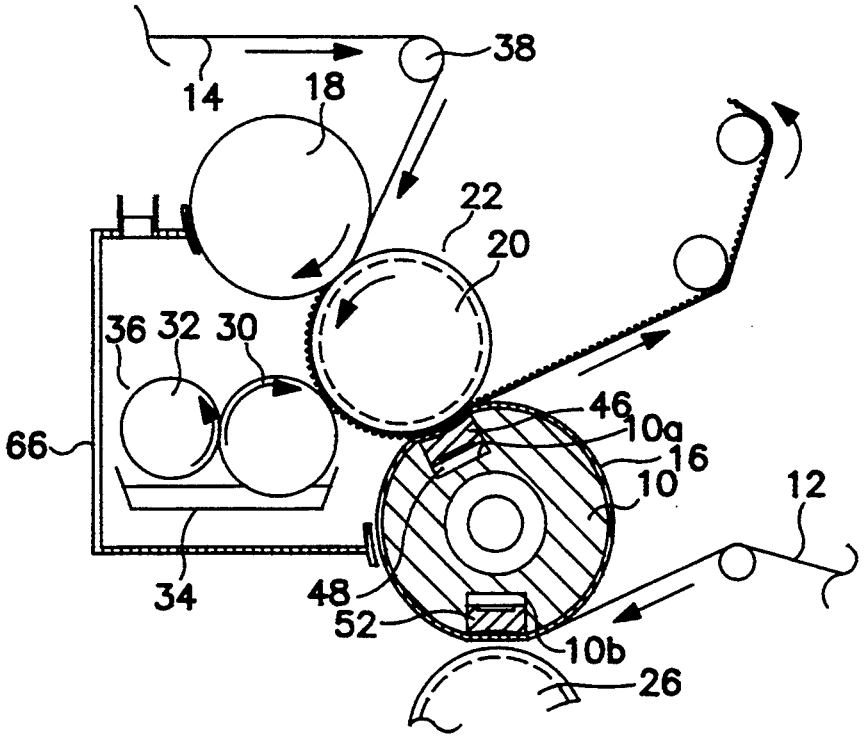
FIG. 9 shows schematically a front view of the first fluting unit in the single facer employing a variation of the means for retaining the corrugating medium in the lower fluted roll according to the preferred embodiment of the invention.

While a suction system was described as the technique of retaining the corrugating medium 14 on the lower fluted roll 20(26) in the embodiment shown in FIGS. 1 to 6, a pressing method (overpressure method), for example, as shown in FIG. 9 can also be employed. To describe this system with respect to the first fluting unit 22, a pressure chamber 66, in which the gluing mechanism 36 is housed, is disposed immediately below the upper fluted roll 18 and diagonally below the lower fluted roll 20, and the pressure chamber 66 is let open toward the upper fluted roll 18 and the lower fluted roll 20, with the opening edges being brought closer to the upper fluted roll 18 and the supporting roll 10. Further, a compressed air is supplied from a source (not shown) to the pressure chamber 66 to provide therein a pressure slightly higher than the atmospheric pressure. In this case, the outer surface of the lower fluted roll 20 facing the pressure chamber 66 is assuming the atmospheric pressure by virtue of the circumferential grooves 20*a* defined at predetermined intervals in the axial direction. Accordingly, the corrugating medium 14 corrugated by passing between the upper fluted roll 18 and the lower fluted roll 20 can be fed stably as pressed against the roll surface due to the difference between the pressure in the pressure chamber 66 and that on the circumference of the lower fluted roll 20. It is of course possible to provide a similar constitution of pressure chamber 66 with respect to the second fluting unit 28 so as to press the corrugating medium 14 against the lower fluted roll 26.

In the embodiment shown in FIGS. 1 to 6, as the means for reducing resistance between the supporting roll 10 and the endless belt 16 which slides as the liner 12 runs, for example, there may be employed a method in which the frictional resistance between the roll 10 and the endless belt 16 is designed to be reduced under the action of the air blown through a plurality of air bleed holes formed to open to the circumference of the supporting roll 10. Further, it is also possible to provide a plurality of bearings on the circumference of the supporting roll 10.

Figure 10:
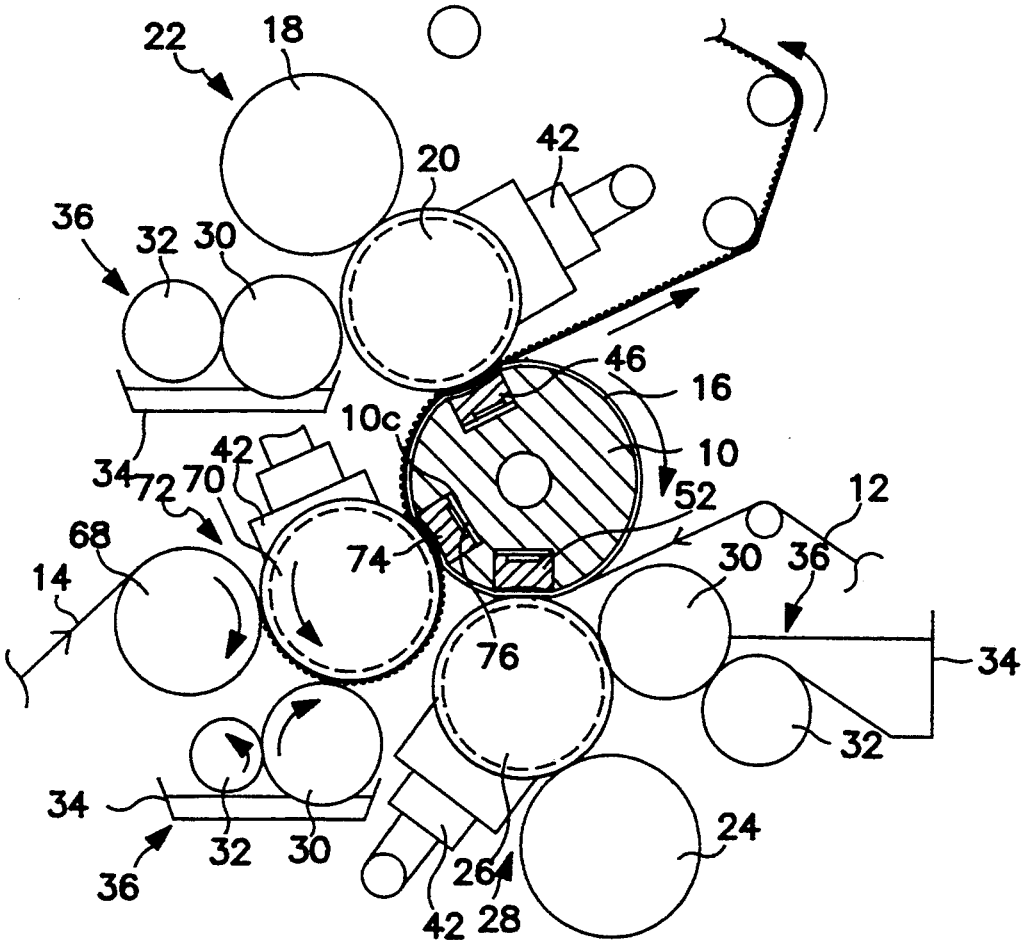
FIG. 10 shows schematically a constitution of the single facer according to another embodiment of the invention.

Further, in the embodiment shown in FIGS. 1 to 6, a constitution in which two fluting units 22,28 are disposed around the supporting roll 10 was described. However, this invention is not limited to this, and three or more fluting units may be disposed. For example, FIG. 10 shows a schematic constitution of the single facer in which three fluting units are disposed. A third fluting unit 72 consisting of a pair of rolls, i.e. an upper fluted roll 68 and a lower fluted roll 70, is disposed on the left side of the supporting roll 10, in addition to the first fluting unit 22 and the second fluting unit 28 described above. A third elongated groove 10*c* is also formed on the supporting roll 10 at the position opposing to the rotation center of the lower fluted roll 70 in the third fluting unit 72 via the endless belt 16, and a third pressing member 74 is disposed in this third elongated groove 10*c* to be slidable in the radial direction of the supporting roll 10. Incidentally, a third pressure space 76 is defined between the bottom of the third pressing member 74 and the bottom of the third elongated groove 10*c*, and the space 46 communicates to a third supply pipe (not shown) led out of an air supply source (not shown) and arranged through the supporting roll 10. Namely, by feeding a compressed air to the third pressure space 76 through the third supply pipe, that portion of the endless belt 16 which opposes to the third pressing member 74 can be brought closer to the lower fluted roll 70 via the third pressing member 74, whereby the liner 12 is pasted to the crests of the corrugating medium 14 with pressure. Thus, a single-faced corrugated board which is of a flute type different from that of the one formed in the first fluting unit 22 or the second fluting unit 28 can be formed.

Moreover, with respect to time means, in the different embodiment shown in FIG. 10, for urging the respective pressing members 46,52,74, the means for supporting the corrugating medium 14 in the lower fluted rolls 20,26,70 and the arrangement of the endless belt relative to the supporting roll 10, the variations described referring to FIGS. 7 to 9 can suitably be employed.

It should be apparent to those skilled in the art that the present invention may be embodied in many other specific forms without departing from the spirit or scope of the invention. Therefore, the present example and embodiment are to be considered as illustrative and not restrictive and the invention is not to be limited to the details given herein, but may be modified within the scope of the appended claims.

What is claimed is:

1. A single facer provided with a plurality of fluting units each consisting of a roll pair consisting of an upper fluted roll having wavy flutes formed on the circumference and a lower fluted roll having wavy flutes formed on the circumference which engage with those of said upper fluted roll and form a predetermined corrugation on a corrugating medium to be passed between said upper fluted roll and said lower fluted roll in the corresponding fluting unit and to paste a liner onto glued crests of said corrugating medium so as to form a single-faced corrugated board;

said single facer comprising:

a single fixed supporting member disposed adjacent to and opposed to all of said lower fluted rolls via a route of feeding said liner fed to the corresponding fluting unit;

a sleeve-shaped endless belt wound around said supporting member to be able to rotate freely therearound; and a plurality of pressing members disposed to oppose, via said endless belt wound around said supporting member, said lower fluted rolls of said fluting units and to be parallel with said lower fluted rolls, respectively; said pressing members being able to be moved, while maintaining a horizontal posture, closer to the corresponding lower fluted rolls under urging by an urging means;

wherein said pressing member is moved closer to said lower fluted roll of the corresponding fluting unit under the action of said urging means to bring that portion of said endless belt opposing to said pressing member closer to said lower fluted roll, so that said liner may be brought into press contact by said endless belt with the glued crests of said corrugating medium fed along the circumference of said lower fluted roll.

2. The single facer according to claim 1, wherein a pair of discs each having a diameter greater than that of said supporting member are rotatably disposed on said supporting member at positions spaced with a predetermined distance in the axial direction of said supporting member, and said endless belt is extended between said discs to be fixed on the circumferences of said discs.

* * * * *